United States Patent [19]

Harris

[11] Patent Number: 4,722,532

[45] Date of Patent: Feb. 2, 1988

[54] MASS PRODUCED STRAIGHT BOOMERANG WITH CONSISTENT FLIGHT CHARACTERISTICS

[76] Inventor: William J. Harris, 5389 Glenburry Way, San Jose, Calif. 95123

[21] Appl. No.: 887,192

[22] Filed: Jul. 21, 1986

[51] Int. Cl.[4] ..... A63B 65/08

[52] U.S. Cl. ..... 273/426

[58] Field of Search ..... 273/426, 424, 425

[56] References Cited

U.S. PATENT DOCUMENTS

| | | | |
|---|---|---|---|
| 4,452,461 | 6/1984 | O'Brien | 273/426 |
| 4,506,894 | 3/1985 | Laux et al. | 273/426 X |
| 4,541,637 | 9/1985 | Atkielski | 273/426 |
| 4,591,164 | 5/1986 | Blight | 273/426 |

FOREIGN PATENT DOCUMENTS

| | | | |
|---|---|---|---|
| 2342756 | 9/1977 | France | 273/426 |

OTHER PUBLICATIONS

Vos, Henk, *American Journal of Physics,* vol. 53, 6–1985, pp. 524–527, Straight Boomerangs of a Balsa Wood and Its Physics.

Mason, Bernard S., *Boomerangs: How to Make and Throw Them,* Dover, 1974, pp. 58–63.

*Primary Examiner*—Paul E. Shapiro

*Attorney, Agent, or Firm*—Richard E. Cummins

[57] ABSTRACT

A straight boomerang which may be massed produced and which provides consistent and reproducible flight characteristics, is constructed based on an analysis of the aerodynamic forces which are operable on the boomerang during its flight and the use of a material which eliminates or minimizes density gradients along both the longitudinal axis and the width axis. In addition, the weight verses lift area ratio is chosen to facilitate the transition of the longitudinal axis of the boomerang immediately after release from a vertical position to a horizontal position which is key to a successful flight pattern.

8 Claims, 5 Drawing Figures

MASS PRODUCED STRAIGHT BOOMERANG WITH CONSISTENT FLIGHT CHARACTERISTICS

FIELD OF INVENTION

This invention relates in general to boomerangs and, in particular, to the type of boomerang referred to in the art as a straight boomerang.

DISCUSSION OF THE PRIOR ART

The prior art has disclosed a number of different type of boomerangs. A publication entitled "*Boomerangs, How to Make and Throw Them*" first published by Dover in 1974, Library of Congress Catalog Card #73-94-346 has a very thorough and informative discussion on boomerangs. Chapter 7 of that publication is directed to hand made straight boomerangs.

Another publication entitled "*Straight Boomerangs of a Balsa Wood and its Physics*" by Henk Vos, page 524 *American Journal of Physics* Volume 53 (6) dated June, 1985 provides a description of the construction of a light straight boomerang made of balsa wood and also a method of throwing it. The article also provides a discussion of the physics involved in the flight path of a straight boomerang.

Straight boomerangs as discussed in the prior art are generally made of balsa wood and are in the range of thirty to sixty centimeters in length, two centimeters in width, and 0.3 centimeters in depth. The straight boomerang is thrown to produce a flight path with is generally in a vertical plane as distinguished from the more common "vee" V shaped boomerang whose flight path is generally in a more horizontal plane. The accepted throwing technique is for the person to grasp the straight boomerang at one end between the thumb and forefinger. The longitudinal axis of the boomerang is generally offset slightly from a vertical plane as it is thrown in an overhead manner with both linear and rotational motions in a slightly upward direction. At the moment of release, the boomerang has a tendency to rotate about the minor axis that is at the time of launch normal to the vertical plane that contains the longitudinal axis of the boomerang. This minor axis extends through the center of mass parallel to the depth dimension of the boomerang. Shortly after release, the longitudinal axis of the boomerang begins a transition to a horizontal plane and a rotation about the longitudinal axis which is generally regarded as the stable axis of rotation of the boomerang. The return phase of the flight path begins as the inertia imparted at the time of release dissipates. At that time, the direction of air flow changes from generally horizontal to vertical as the boomerang begins to fall. The rotation of the boomerang about its longitudinal axis in the horizontal plane causes the boomerang to begin its return path to the launch point. In order to return to the launch point, the design of the boomerang must be such that during this critical phase, the boomerang is able to rotate about its longitudinal axis with sufficient rotational speed to actually produce a lift to minimize the effect of gravity and allow a glide path that is shallow enough to reach the launch point at a reasonable height relative to the launch point.

While the prior art provides some general suggestions on the basic design of the straight boomerang, there is no teaching on how to mass produce straight boomerangs with consistent and predictable flight characteristics. The methods suggested in the prior art generally do not lend themselves to mass production techniques nor do they tend to provide a straight boomerang with consistent predictable and repeatable flight patterns.

SUMMARY OF THE INVENTION

The present invention provides a straight boomerang which may be massed produced and which provides consistent and reproducible flight characteristics. The improved design is based on an analysis of the aerodynamic forces which are operable on the boomerang during its flight and the use of a material which eliminates or minimizes density gradients along both the longitudinal axis and the width axis. In addition, the weight verses lift area ratio is chosen to facilitate the transition of the longitudinal axis of the boomerang immediately after release from a vertical position to a horizontal position.

It is therefore an object to the present invention to provide an improved boomerang.

A further object of the present invention is to provide a straight boomerang having flight characteristics which are readily reproducible.

Another object of the present invention is to provide a straight boomerang which can be massed produced in a manner that provides consistent and predictable flight characteristics.

A still further object of the present invention is to provide an improved straight boomerang which has a relatively stable axis of rotation parallel to its longitudinal axis.

A still further object of the present invention is to provide a straight boomerang in which the ratio of surface area to weight is in an range which facilitates the transition of the boomerang immediately after release from a first position where the longitudinal axis is in a vertical plane to a second position where the longitudinal axis is in a horizontal position.

Objects and advantages other than those mentioned above will become apparent from the following description when read in connection with the drawing.

DESCRIPTION OF THE PREFERRED EMBODIMENT

Figure 1:
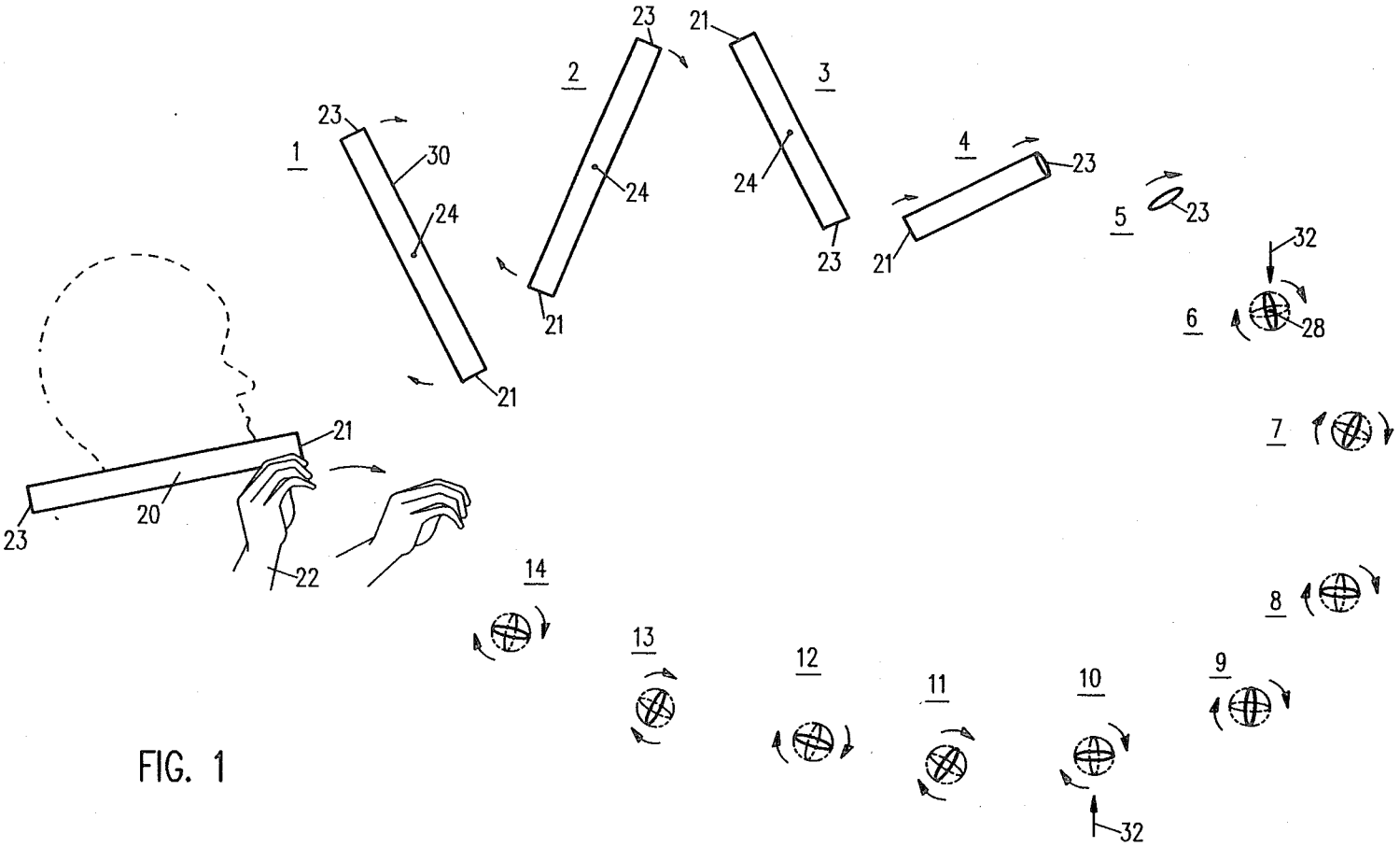
FIG. 1 illustrates diagrammatically the launching and flight path of a typical straight boomerang.
Figure 2:
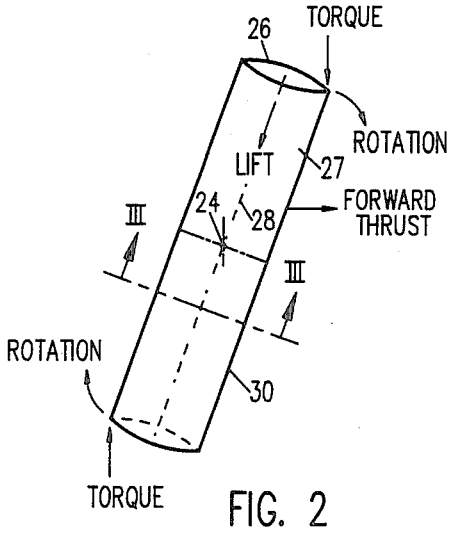
FIG. 2 is a perspective view of a preferred embodiment of a straight boomerang in accordance with the present invention.

The launching and flight path of a straight boomerang 20 is illustrated in FIG. 1. The preferred launching technique has one end 21 of the boomerang 20 held between the thumb and forefinger of the person throwing the boomerang represented in FIG. 1 by the hand 22. The boomerang 20 as shown in FIG. 1 is thrown in a generally uphill direction with a force that imparts both a forward motion and a rotational motion about the axis 24 which in positions P1–P3 in FIG. 1 lies substantially parallel to a horizontal plane. Axis 24 as shown in FIG. 2 extends through the center of mass of the boomerang between air foil surfaces 26 and 27.

Two important aerodynamic effects are involved in the flight. The "air foil" and the "magnus" lifting rotor principals both play an important part in the flight path of the straight boomerang. The lifting force on an air foil is well known to be directly proportional to the square of the linear velocity of the air foil. A straight air foil rotating through the air while being thrust with linear velocity experiences greater lift on the end moving in the direction of the thrust then the opposite end, that rotates away from the direction of thrust. This action tends to drive the rotating air foil, which has been thrust with the longitudinal axis in a vertical plane, to a horizontal plane. In addition to the lifting force on an air foil there is a moment at the leading edge tending to increase the angle of incidence with the direction of air foil. For an air foil rotating with forward linear thrust, the moment at the edge rotating in the thrust direction forms a mechanical couple with the moment in the other arm which rotates away from the thrust direction. A torque results that attempts to spin the air foil about its longitudinal axis.

An extended structure such as a cylinder or a wing configuration spinning on a longitudinal axis is known to the aerodynamic art as a "magnus" lifting effect rotor. It is generally accepted, that a "magnus" lifting device produces aerodynamic circulation of the air flow which, when superimposed on a linear air flow perpendicular to the longitudinal axis, can cause considerable lift. The cross section of a spinning structure, however, also produces much drag. A freely falling "magnus" rotor experiences upward lift when the lower arms rotate toward the glide direction and a negative lift when they rotate away from the glide direction.

The general flight path as seen in FIG. 1 consists of the looping in a vertical plane returning to the proximity of the release point. The boomerang, as explained earlier, is released at head height, thrown forward from a thumb and forefinger grasp, with the long axis approximately in a plane perpendicular to the horizon (vertical). Simultaneously, a clock-wise rotation as viewed in FIG. 1 is added. While a toss in a slightly upward direction is preferred, the horizontal direction can also produce a satisfactory performance with the correct design or with skill of the thrower.

After release the long axis 28 rotates from the vertical plane to the horizontal plane. It does this by the end 23 at position 1 moving either left or right depending on the direction of the leading edge 30 at the time of release. This sideways movement is caused by a downward lift force which is associated with air foil behavior as described previously. This force is exerted primarily on the hand held end 21 since it experiences a greater air velocity than the opposite tip 23 that is rotating away from the release direction. Simultaneously, the air flow causes a moment at the leading edge 30 that spins the boomerang around its longitudinal axis 28 in a clockwise direction as seen in FIG. 1 positions P6–P14.

After release, the edge 30 also experiences the greatest drag force, which rapidly decelerates the leading edge. If the rotating boomerang has the optimum inertia it attains position 5 in FIG. 1 with a high spin about the longitudinal axis 28. However, if the inertia is too great, the hand held end 21 rotates beyond the other end 23 and returns at a angle away from the thrower. When the inertia is especially high, the boomerang will loop end over end traveling away from the point of release. For a low inertia unit position 5 in FIG. 1 is not reached and the boomerang spins and gyros to the ground. The inertia aspects of the design and launch are therefore important to flight characteristics.

The spinning around the longitudinal axis 28 generates a humming sound. This rapid clockwise spin as viewed in FIG. 1, slows the boomerang due to a sudden drag increase along the length of the boomerang. After dissipation of the forward inertia the boomerang falls, as a result of gravity and also a downward force which is referred to as the "Bernoulli Effect" and is similar to the effect on spinning balls or cylinders.

The behavior that has been understood to contribute to flight characteristics is the Bernoulli Spin phenomena since it is well known that a cylinder or rotor spinning in an air stream generates the lifting force in the manner shown in FIG. 1.

As previously mentioned, the Bernoulli Spin is initiated by a moment at the edge 30 along the length of the boomerang 10. When position 5 FIG. 1 is reached the downward lift, represented by arrow 32, from the Bernoulli Spin results in a rapid fall to position 9 of FIG. 1. In this phase the highest humming sound is created. This increase in sound is caused by an increase rate of spin resulting from the clockwise rotation of the Bernoulli lift vector 32, from pointing down to pointing up in position 10, which applies a torque around the longitudinal axis 28. This rotation of the lift vector 32 also reverses flight direction, hence the boomerang effect.

Figure 3:
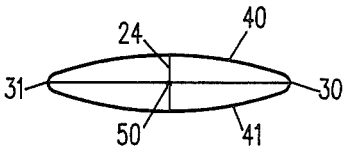
FIG. 3 is a cross sectional view of the boomerang shown in FIG. 2 taking along the line III—III in FIG. 2.
Figure 4:
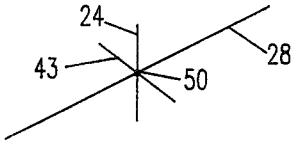
FIG. 4 is a view showing the three principal axes of the boomerang shown in FIG. 1.
Figure 5:
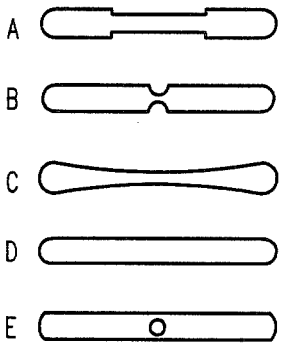
FIG. 5A–5E illustrate various designs which may be employed for straight boomerangs following the teachings of the present invention.

An important design consideration relative to the Bernoulli Spin is the edge configuration. It has been suggested that only one air foil surface be provided so that only 2 edges are radiused. This means only one curved edge is directed at the air stream while the edge associated with the flat surface is straight and therefore increases drag. A more efficient design, shown in FIG. 3, minimizes air drag since edges 30–31 are fully curved or radiused.

The most significant criteria to the successful flight characteristics involves the ratio of the weight to lift area. The lift area is the area of the air foil surfaces 40 and 41 shown in FIG. 2. This ratio is particularly meaningful in the release phase. If it is too great, the resultant high rotational inertia inhibits translation to the horizontal orientation causing unstable erratic motions in arcing to the ground. If the ratio is to low, the torquing along the longitudinal axis dominates and the structure spins rapidly down. There are numerous other unstable reactions between these two extremes. The requisite weight to lift area ratio of 0.035 to 0.065 grams per square centimeter is necessary to accomplish transition from the vertical to the horizontal plane after release. The ratio range was arrived at experimentally.

An optimum structure should be rigid comparable to wood. Other examples include plastics, foams, and reinforced paper products. Specifically, balsa wood is a good example, however, mass production of balsa wood structures is very expensive.

The preferred weight of the structure is in a range of 2–7 grams but the final weight depends primarily on the dimensions and the pivotal air foil ratio, weight to lift area.

A range of dimensions are possible that produce consistent and stable performance provided the critical weight to lift area ratio is within the defined range. The major contributions of the thickness dimension which is parallel to axis 24 is to member rigidity. It is therefore generally desirable to design to a minimum without losing longitudinal rigidity. An increase drag in air foil and magnus spin dynamics is experienced as the thickness increases which further justifies incorporating a minimal thickness dimension.

Selecting the width dimension which is parallel to axis 43 involves trade-offs between structural properties and performance characteristics. The width dimension must be of significant magnitude to satisfy the weight to lift area ratio restriction. At release, widths around 2.5 cms. are aesthetically pleasing because of their surprising return in the boomerang loop. The "magnus" spin develops more slowly compared to a 1.5 cm. width which adds to the dramatic dynamics. However, in the return mode, the greater widths fall more rapidly and they may not rise during the glide portion of the return path unless adequate inertia is imparted at release. On the other hand, the smaller width excels in return mode due to the reduced cross sectional drag in the direction of glide. A high "magnus" spin rate develops because the narrow design has less inertia to accelerate. As expected, narrowed designs intensify the "humming" sound.

The length dimension which is parallel to axis 28 is part of the weight/lift area ratio. In addition, if affects trajectory parameters from the point of release. A 30 cm. structure thrown by a 6 foot tall person travels heights and distances about 7–8 feet. A 60 cm. unit reaches 9 to 10 feet in height and distance. The skill of the thrower may influence trajectory extremes.

The surface condition of the air foil surfaces 40 and 41 should be in general relatively smooth. Since the boomerang acts as a air foil and a "magnus" rotor, surface drag should be kept as low as material selection allows. To alter the surface conditions a coating spray or other material may be applied as the finished surface. Also, surfaces can be artistically decorated to enhance appeal as a toy boomerang without adversely affecting flight characteristics.

Another structural requirement is the absence of density gradients, especially in the longitudinal and width dimensions. Unsymmetrical density gradients can promote mild to extreme gyroing in the return path. Erratic motions may also occur at release. In practice, density gradients may be difficult to eliminate, but whenever practical should be kept to minimum if performance throwing from any of the four possible holding orientations is important.

Manufacturing the structure with negligible density gradients also fixes radii of gyration in an orthogonal relationship which is indispensable to stable performance. The significant axes of rotation are the longitudinal axis 28 and the width axis 24. The radii of gyration must also be coincidental to the geometric axis. This is realized when the structures have 3 fold symmetry and maintain strict dimensional limits. The center of gravity of the structure should be situated near the geometrical center 50, which corresponds generally to the intersection of the 3 axes. Otherwise, adverse gyroing in flight will occur.

FIGS. 5A–5E illustrate various modifications to the general design of the structure shown in FIG. 2 in which the criteria which were employed in the structure of FIG. 2 are still maintained even though the overall appearances are different.

It has been found that straight boomerangs of the designs illustrated may be mass-produced by means of injection molding processes which employ suitable materials which have molded densities that result in the weight lift area ratio of the particular design to fall within the critical range of 0.035 to 0.065 grams per square centimeter.

It should also be understood that if desired, additional weights may be added to the boomerang provided they are placed symmetrically on the boomerang and provided they do not cause the overall critical weight to lift ratio to extend beyond the critical range.

While the invention has been described in connection with a preferred embodiment and minor modifications to the overall appearance of the boomerang, it should be understood that other modifications may be made to the basic structure without departing from the spirit and scope of the appended claims.

I claim:

1. A straight boomerang structure comprising a pair of generally rectangular air foil surfaces having lengthwise dimensions disposed parallel to the longitudinal axis of said structure, said air foil surfaces being joined at their perimeters to provide a generally elliptical cross-section in which said longitudinal axis intersects the center of said elliptical cross-section in an orthogonal relationship and the edges of said structure parallel to said lengthwise dimension are curved to produce minimum drag when said structure rotates about said longitudinal axis, said structure having a weight to lift area ratio which facilitates the transition of said structure immediately after launch from a first position where said longitudinal axis is in a vertical plane to a second position where said longitudinal axis is in a horizontal plane thereby causing a reversal of direction relative to the launch point and a glide path which is sufficiently shallow to reach the return point at a reasonable height.

2. The structure set forth in claim 1 in which each said air foil surface has a generally rectangular outline.

3. The structure set forth in claim 2 in which said structure is a solid unitary member of injection moldable material.

4. The structure set forth in claim 3 in which the density of said material is substantially constant throughout said structure.

5. The structure recited in claim 4 in which said geometric center coincides with the center of mass of said structure.

6. The structure set forth in claim 3 in which the density of said material varies symetrically realative to the geometric center of said structure.

7. The structure recited in claim 2 in which said weight to lift area ratio is in the range of 0.035 to 0.065 grams per square centimeter.

8. The structure recited in claim 2 in which said longitudinal axis has a length in the range 30 to 60 centimeters with the major axis of said elliptical cross section being substantially 2 centimeters and the minor axis being substantially 0.3 centimeters in length.

* * * * *